US005339765A

United States Patent [19]

Ward

[11] Patent Number: 5,339,765

[45] Date of Patent: Aug. 23, 1994

[54] DIRECTION INDICATING TRAFFIC BARRICADE

[76] Inventor: James E. Ward, 4823 Marigold Cir., Bossier City, La. 71111

[21] Appl. No.: 46,199

[22] Filed: Apr. 14, 1993

[51] Int. Cl.[5] ..... E01F 13/00; G09F 9/40

[52] U.S. Cl. ..... 116/63 P; 116/321; 256/64; 40/488; 40/612

[58] Field of Search ..... 116/44, 45, 50, 63 R, 116/63 P, 321, 323, 324; 40/488, 489, 490, 491, 612; 256/1, 13.1, 64; 404/6, 9

[56] References Cited

U.S. PATENT DOCUMENTS

| | | | |
|---|---|---|---|
| 711,240 | 10/1902 | Zaring | 40/488 X |
| 2,793,003 | 5/1957 | Borchers | 256/64 |
| 2,824,719 | 2/1958 | Nutting | 256/64 |
| 2,942,854 | 6/1960 | Harding | 256/64 |
| 4,183,695 | 1/1980 | Wilcox | 404/6 |
| 4,663,872 | 5/1987 | Finger | 40/488 |
| 5,235,768 | 8/1993 | Eder | 40/488 |

FOREIGN PATENT DOCUMENTS

| | | | |
|---|---|---|---|
| 0416712 | 1/1967 | Switzerland | 116/63 P |
| 2194268 | 3/1988 | United Kingdom | 116/63 P |

*Primary Examiner*—William A. Cuchlinski, Jr.
*Assistant Examiner*—Willie Morris Worth
*Attorney, Agent, or Firm*—Shook, Hardy & Bacon

[57] ABSTRACT

A visual message indicating barricade is presented having a support means adapted to hold the barricade in a relatively upright position, at least one body affixed to said support by a securing means, at least one selectively movable member connected to the body, and at least one visually discernible message presented corresponding to each of the members, wherein the members can be selectively positioned in either a concealing or a revealing position with respect to the visual message corresponding thereto.

17 Claims, 1 Drawing Sheet

DIRECTION INDICATING TRAFFIC BARRICADE

BACKGROUND OF THE INVENTION

The present invention relates generally to traffic control devices and, more specifically, to a direction indicating traffic barricade.

When a roadway is in disrepair, or when other hazards exist on the roadway, steps must be taken to ensure that motorists and pedestrians are warned of the obstruction. This need is most readily dispatched by warning motorists or pedestrians of the hazard and then directing them to a route avoiding the hazard.

Until now, the tasks of warning the oncomer of the obstruction and redirecting the course of the oncomer have been accomplished by separate devices. For example, if a roadway was for some reason in a dangerous condition, roadway maintenance crews would first erect a barricade immediately adjacent to the hazard. Next, the crews would establish some direction indicating device ahead of the hazard to redirect oncomers away from the barricaded hazard. Though workable in most circumstances, an arrangement such as this is costly in both time and equipment and is needlessly complex.

SUMMARY OF THE INVENTION

It is, therefore, an object of the present invention to provide a direction indicating traffic barricade which both warns the oncomer of the hazard and redirects the oncomer to the preferred route avoiding the hazard.

It is another object of the present invention to provide a direction indicating traffic barricade equipped with at least one and preferably more than one direction indicating messages which may be conveniently selectively revealed to reroute oncoming traffic in a desired direction.

It is a further object of the present invention to provide a direction indicating traffic barricade which has a variety of visual messages and therefore is suitable for a plurality of traffic control situations, and which is capable of meeting a variety of work site demands efficiently and cost effectively.

The above and other objects of invention will in part be obvious and will be hereinafter more fully pointed out in connection with the detailed description and accompanying drawings.

To accomplish these and other related objects of the invention, a traffic barricade is disclosed which provides associated direction indicating means. In a preferred form, it comprises a relatively upright support means. Attached by securing means to the support is at least one body which is preferably relatively flat-sided. It is contemplated by this invention that the body could also be workable in other forms, such as tubular or angled. Movably connected to the body is at least one, and preferably a plurality of members. The members are likewise preferably flat-sided, although other forms corresponding to the particular form of the body can be used. This flat-sided member is selectively movable. In one embodiment the member is slidably movable along the flat-sided body in the plane occupied by the greatest surface area of the body. In an alternative embodiment, as with a tubular body, the member is slidably movable along the axis of the tubular body, or above or below the same. In yet another embodiment, as where the member is attached to the body by hinge means, the member is pivotally movable with respect to the body.

A visual message is imprinted upon the body at a location beneath the movable member when the member is in its stationary or concealing position. When selectively moved to its concealing position, the member's position is preferably essentially flush against the outer surface of the body. When the member is selectively moved to its revealing position, the message is able to be viewed forwardly.

In the preferred form, members are dispensed across at least one body. Positioned on the body under the members are reflectively painted opposed outwardly directing arrows or other message indicators. In operation, the members are slidable along the body to reveal the message indicators, or are alternatively pivotally movable with respect to the body, thereby forwardly displaying the desired instructional. message, such as directing oncoming traffic in the desired direction.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENTS

Figure 1:
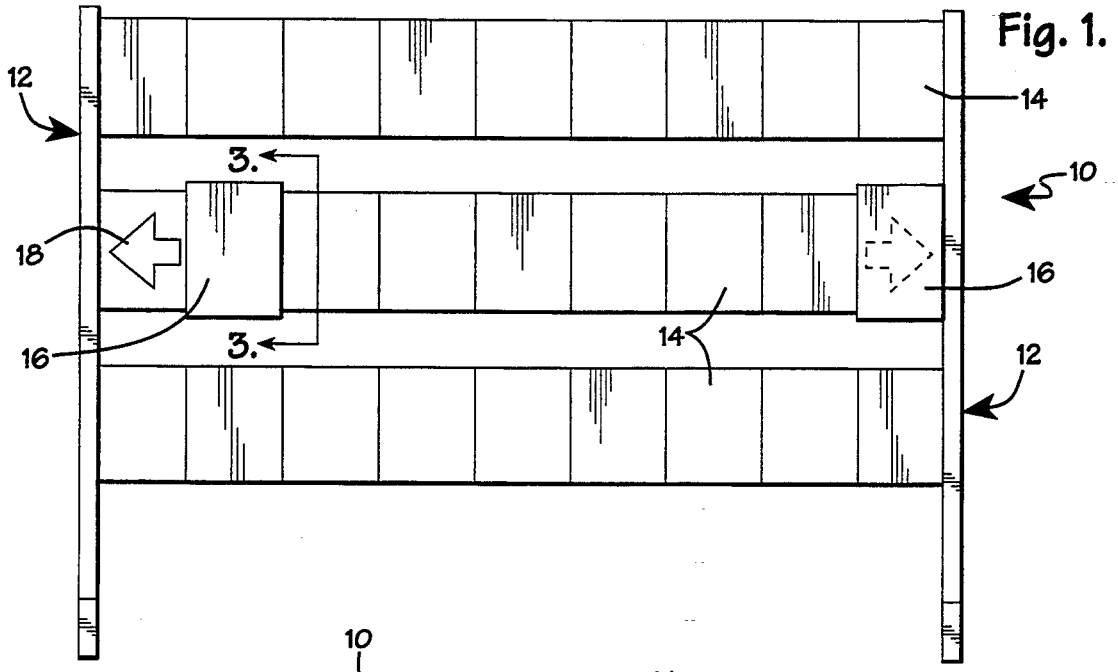
FIG. 1 is a front elevational view of a direction indicating traffic barricade constructed in accordance with the present invention, showing a slidable member in position to reveal an arrow directing oncoming traffic to the left.
Figure 2:
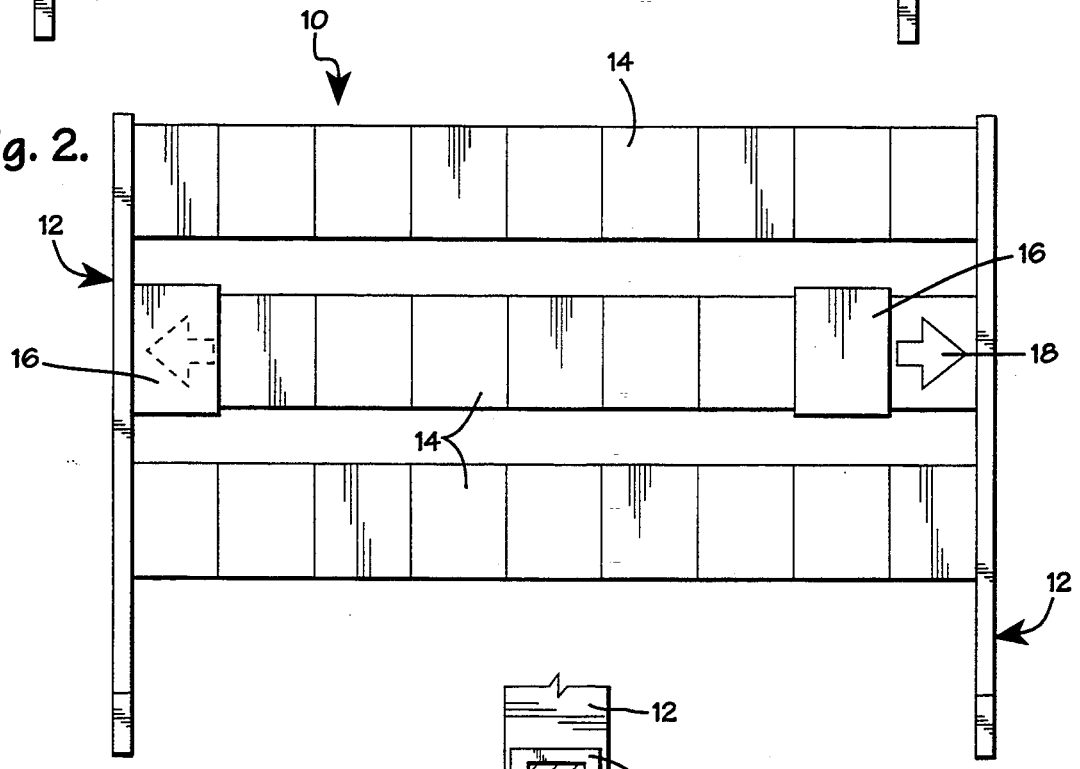
FIG. 2 is a front elevational view of the direction indicating traffic barricade shown in FIG. 1 depicting a slidable member positioned to reveal an arrow directing oncoming traffic to the right.

Referring now to the drawings in greater detail, and initially to FIG. 1 and FIG. 2, a direction indicating traffic barricade made in accordance with the present invention is represented broadly by the numeral 10. In the preferred embodiment, the barricade 10 is held in a standing position relatively upright by a support means 12. Any conventional support means 12 adapted to present the barricade 10 in a substantially upright position may be utilized in the present invention. In the preferred embodiment, the support means 12 comprises a relatively upright rigid extension which allows the barricade 10 to stand independently upright.

At least one body 14 is securely attached to the support means 12. In a preferred embodiment, a plurality of bodies 14 are attached to the support means 12 to present a conspicuous barrier. Most preferably, two or three such bodies 14 are used. FIGS. 1 and 2 depict three bodies 14 comprising the barricade 10. Each body 14 is affixed to the support means 12 by any conventional securing including, but not limited to, bolting, welding, gluing or integral molding. The body 14 of the preferred embodiment is flat-sided, having a front portion 24 thereof, and, most preferably, is in the form of an elongated plank or some other sizeable object. Other forms of the body 14 which would allow a degree of lateral presentation are anticipated and, thus, within the scope of invention. These would include tubular or angled bodies, among others. The material used to construct the body 14 is preferably able to withstand the rigors of the weather, including extreme temperatures, moisture, wind, etc. Any conventional commercially available durable material may be used. The body 14 of the preferred embodiment is also coated at least partially with a reflecting substance, such as reflective paint, reflective tape, or the like.

Movably attached to at least one body 14 is at least one member 16. In one embodiment, a plurality members 16 are selectively movably attached to the body 14 at spaced apart portions of said body 14. In the preferred embodiment depicted in FIGS. 1 and 2, two members 16 are provided, each member 16 being flat-sided in the form of a plank or slat. The member 16 may, alternatively, be of any workable form, such as tubular, angled, or polygonal which would allow at least partial occlusion of the lateral presentation of the body 14. The particular form of the member 16 should correspond to the particular form of the corresponding underlying body 14.

The member 16 is movably attached to the body 14 by any conventional means which would allow limited relative movement of the member 16 with respect to the body 14. For instance, the member 16 could be of a shape which wraps around the body 14 thereby allowing the member 16 to securely slide along the length of the body 14. Preferably, the attaching means would allow limited sliding movement of the member 16 along the longitudinal axis of the body 14. In an alternative embodiment, the member 16 is attached to the body 14 by hinge means (not shown) thereby allowing the member 16 to be pivotally turned from the body 14.

Figure 3:
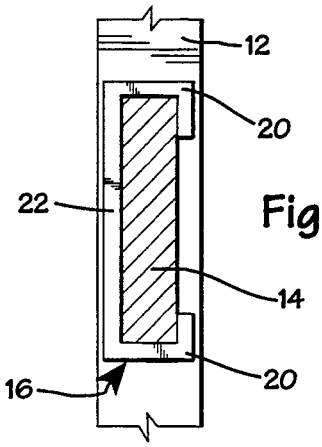
FIG. 3 is an enlarged fragmentary side elevational view of the direction indicating traffic barricade shown in FIG. 1, taken in vertical section along line 3—3 in the direction of the arrows, illustrating the sliding mechanism employed by the movable member.

As can be seen in FIG. 3, the member 16 of the preferred embodiment is essentially flush against the outer surface of the body 14. Flanges 20 of member 16 are depicted, and it is seen that the front portion 22 of member 16 and flanges 20 substantially encase three sides of body 14, securing member 16 to body 14 in a cooperating relationship. As indicated, conventional attaching means which would allow the member 16 to selectively move at least partially with respect to the front portion 22 of the body 14 are contemplated by this invention.

Disposed on at least one body 14 is at least one visual message 18. A plurality of messages 18 are disposed on the front portion 24 of the body 14 thereby allowing the barricade 10 to be used in varying situations requiring different warnings or directions. The visual message 18 can be in the form of any word or symbol which would convey a message to oncoming pedestrians or traffic. In the preferred embodiment, the visual message 18 is in the form of at least one and preferably two opposed directional arrows which assist in directing oncomers around the barricade 10 and the associated roadway obstruction. Visual message 18 is preferably comprised of a paint or paint-like substance applied to the barricade, such as a light reflective substance. It is understood, however, that other media would be suitable for providing the visual message 18, such as reflective tape, illuminating devices, supplemental figures, and embossed words.

A member 16 is correspondingly provided with each visual message 18. Members 16 can be selectively disposed along the body 14 in two positions. First, a concealing position is provided, as indicated by the right member 16 in FIG. 1 and the left member 16 in FIG. 2, wherein member 16 is disposed over the visual message 18 to hide the same from view. The second, revealing position is indicated by the left member 16 in FIG. 1 and the right member 16 in FIG. 2, wherein member 16 is disposed adjacent visual message 18 to allow viewing of the same.

In operation, the barricade 10 is placed immediately adjacent to, and preferably in front of, a roadway hazard of some kind. The member 16 is selectively slidably moved along the body 14 to either the concealing or the revealing position in order to display the desired visual message 18, such as the desired direction indicator located upon the body 14. Once the hazard has been repaired, the barricade 10 is simply removed from the site. To use the barricade 10 again for the same or a different hazard, the barricade 10 can be repositioned and the newly desired visual message 18 can then be displayed in accordance with the steps outlined above.

From the foregoing, it will be seen that this invention is one well-adapted to attain all the ends and objectives herein above set forth together with other advantages which are obvious and which are inherent to the device.

It will be understood that certain features and subcombinations are of utility and may be employed without reference to other features in subcombinations. This is contemplated by and within the scope of the claims.

Since many possible embodiments may be made of the invention without departing from the scope thereof, it is to be understood that all matter herein set forth or shown in the accompanying drawings is to be interpreted as illustrative and not in the limiting sense.

Having thus described the invention, what is claimed is:

1. A visual message indicating traffic barricade for removable placement adjacent to a road hazard, said traffic barricade comprising:

a portable support means adapted to hold said traffic barricade in a relatively upright position;

means for securing a plurality of bodies to said support means;

at least one member selectively movably connected to at least one said body; and at least one visual message presented upon at least one said body corresponding to each said member, whereby said message can be selectively occluded by positioning said member over said message in a first concealing position, and whereby said message can be selectively visually discerned by positioning said member away from said message in a second revealing position.

2. The barricade as set forth in claim 1 wherein a front portion of said at least one body is flat-sided.

3. The barricade as set forth in claim 2 wherein said at least one body is elongated.

4. The barricade as set forth in claim 3 wherein said at least one member is fiat-sided and cooperates with said front portion of said at least one body.

5. The barricade as set forth in claim 4 wherein said at least one member is selectively movably connected to said at least one body by slidable means.

6. The barricade as set forth in claim 5 wherein said slidable means are adapted to allow movement of said at least one member in a direction substantially parallel to the longitudinal axis of said at least one body.

7. The barricade as set forth in claim 4 wherein said at least one member is selectively movably connected to said at least one body by hinge means.

8. The barricade as set forth in claim 1 wherein a portion of said at least one body is coated with a reflecting substance.

9. The barricade as set forth in claim 1 wherein said securing means includes one of welding, bolting, gluing and integral molding.

10. The barricade as set forth in claim 1 wherein said visual message is painted upon said at least one body.

11. The barricade as set forth in claim 1 having two said members and two corresponding said visual messages, wherein said messages are opposed direction indicating arrows.

12. The barricade as set forth in claim 1, having a plurality of said members and a corresponding plurality of said visual messages.

13. A visual message indicating traffic barricade for removable placement adjacent to a road hazard, said traffic barricade comprising:

a portable support means adapted to hold said traffic barricade in a relatively upright position;

a plurality of relatively elongated flat-sided bodies affixed to said support means, said bodies oriented to laterally present a front surface area of said bodies;

at least one relatively flat-sided member affixed to at least one said body by a means for providing a slidably movable connection;

at least one visual message presented upon said at least one said body corresponding to each said member, whereby said message can be selectively occluded by positioning said member over said message in a first concealing position, and whereby said message can be selectively visually discerned by positioning said member adjacent to said message in a second revealing position.

14. The barricade as set forth in claim 13 wherein a portion of said at least one body is coated with a reflective substance.

15. The barricade as set forth in claim 13 wherein said slidably movable connection means are adapted to allow movement of said member in a direction substantially parallel to the longitudinal axis of said body.

16. The barricade as set forth in claim 13 having two said members and two corresponding said visual messages, wherein said messages are opposed direction indicating arrows.

17. The barricade as set forth in claim 13, having a plurality of said members and a corresponding plurality of said visual messages.

* * * * *